US010717203B2

(12) United States Patent
Schuster et al.

(10) Patent No.: US 10,717,203 B2
(45) Date of Patent: Jul. 21, 2020

(54) APPARATUS AND METHOD FOR ROTARY DIE X, Y, AND THETA REGISTRATION

(71) Applicant: Preco, Inc., Lenexa, KS (US)

(72) Inventors: Randy Schuster, Lee's Summit, MO (US); Jay Norlinger, New Brighton, MN (US)

(73) Assignee: Preco, Inc., Lenexa, KS (US)

( * ) Notice: Subject to any disclaimer, the term of this patent is extended or adjusted under 35 U.S.C. 154(b) by 277 days.

(21) Appl. No.: 15/335,977

(22) Filed: Oct. 27, 2016

(65) Prior Publication Data

US 2018/0117786 A1 May 3, 2018

(51) Int. Cl.

| | |
|---|---|
| ***B26D 5/02*** | (2006.01) |
| ***B26D 1/62*** | (2006.01) |
| ***B26F 1/38*** | (2006.01) |
| ***B26D 5/00*** | (2006.01) |

(52) U.S. Cl.

CPC ..... *B26D 5/007* (2013.01); *B26D 1/626* (2013.01); *B26D 5/02* (2013.01); *B26F 1/384* (2013.01); *Y10T 83/0515* (2015.04); *Y10T 83/06* (2015.04); *Y10T 83/536* (2015.04); *Y10T 83/538* (2015.04)

(58) Field of Classification Search

CPC ..... B26D 1/62; B26D 1/626; B26D 5/007; B26D 5/02; B26D 2001/623; B26F 1/384

USPC ..... 83/360, 364, 365, 367, 368, 371

See application file for complete search history.

(56) References Cited

U.S. PATENT DOCUMENTS 4,481,533 A * 11/1984 Alzmann et al. ..... B26D 7/015 348/95
4,697,485 A * 10/1987 Raney ..... B26D 7/2628 83/209
4,971,304 A * 11/1990 Lofthus ..... B65H 7/06 198/395
5,079,981 A * 1/1992 Singer et al. ..... B26D 5/26 83/216
5,098,507 A * 3/1992 Mao ..... B29C 59/04 156/209
5,212,647 A * 5/1993 Raney et al. ..... B26D 5/007 348/95
5,586,479 A * 12/1996 Roy et al. ..... B26D 7/015 346/24
5,644,979 A * 7/1997 Raney ..... B26D 7/015 100/226
5,777,878 A * 7/1998 Helmrich et al. ..... B41F 15/10 101/115

(Continued)

*Primary Examiner* — Clark F Dexter
(74) *Attorney, Agent, or Firm* — Hovey Williams LLP

(57) ABSTRACT

A rotary die apparatus and method for three-axes registration error correction. The rotary die apparatus includes a rotary die for applying patterns to a strip of material, a sensor for sensing fiducials on the strip of material, actuators to adjust the rotary die, and a control system. The actuators adjust the rotary die along an X-axis extending along a direction of travel, along a Y-axis transverse of the direction of travel, and about a theta axis perpendicular to the X-axis and the Y-axis. The control system calculates a registration error based on a difference between an actual location or orientation of the fiducials and a desired location or orientation of the fiducials. Then the control system outputs control signals to the actuators to adjust the rotary die along the X-axis, along the Y-axis, and/or about the theta axis while the rotary die continues to rotate.

18 Claims, 11 Drawing Sheets

(56) References Cited

U.S. PATENT DOCUMENTS

| | | | | |
|---|---|---|---|---|
| 5,794,526 | A * | 8/1998 | Raney | B26D 7/015 100/229 R |
| 6,209,435 | B1 * | 4/2001 | Miyazaki et al. | B26D 3/085 83/300 |
| 6,546,833 | B1 * | 4/2003 | Gifford et al. | B26D 7/015 83/34 |
| 6,820,526 | B1 * | 11/2004 | Maddalon | B26D 5/34 83/210 |
| 6,871,571 | B2 * | 3/2005 | Raney et al. | B26D 5/32 269/21 |
| 7,055,418 | B2 * | 6/2006 | Maddalon | B26D 5/32 83/364 |
| 7,100,484 | B2 * | 9/2006 | Maddalon | B26D 11/00 83/74 |
| 7,640,836 | B1 * | 1/2010 | Raney et al. | B26D 5/32 269/21 |
| 2002/0050202 | A1 * | 5/2002 | Raney et al. | B26D 5/32 83/559 |
| 2003/0033918 | A1 * | 2/2003 | Maddalon | B26D 5/32 83/74 |
| 2004/0182211 | A1 * | 9/2004 | Maddalon | B26D 11/00 83/74 |

* cited by examiner

APPARATUS AND METHOD FOR ROTARY DIE X, Y, AND THETA REGISTRATION

BACKGROUND

Many industries use die cutting, laser cutting, printing, embossing, or stamping to create a series of patterns on a continuous strip of material or web of material by passing the material between a pair of cooperatively rotating cylinders including a rotary die cylinder of a rotary die. This technique may be used, for example, to cut holes or other patterns onto a printed strip of material at desired locations relative to indicia printed thereon. When the patterns are positioned at specific locations relative to each other or relative to pre-applied indicia, the patterns are said to be "in registration."

Registration may be achieved with a controller or other control device. The controller maintains a die cut at the same interval as the repeat of patterns and/or indicia on the strip of material. To initially line up the die and patterns applied on the strip of material, an operator offsets a registration target position, which shifts the die patterns up or down the strip of material, effectively lining up the intervals of the strip of material and the die. However, the strip of material can move or slip out of alignment with the rotary die due to factors like a natural camber of the material, splices which may affect the material, other material properties, discrepancies introduced due to previous operations to the strip of material, etc. If one of the patterns is not positioned precisely at the desired location on the strip of material, a "registration error" occurs. One type of registration error may occur in the machine direction, or in the direction of movement of the strip of material, along an X-axis. A second type of registration error may occur in a direction perpendicular to the X-axis, in a side-to-side direction relative to the strip of material along a Y-axis. A third type of registration error may occur if the strip of material and/or the rotary cylinders of the rotary die are not angled correctly about a theta axis T, which is perpendicular to both the X-axis and the Y-axis.

Manual methods for determining registration errors for each pattern applied to the strip of material are too time-consuming for mass production operations. Prior art automated methods of measuring and calculating registration errors involve complex and/or numerous equations and compare statements, which can slow the processing time and the processing capability needed to determine the registration errors and correct for them "on the fly" or in a substantially continual manner for each pattern.

Accordingly, there is a need for a method and apparatus for correcting registration errors that overcomes the limitations of the prior art.

SUMMARY

Embodiments of the present invention solve the above-mentioned problems by providing a rotary die apparatus and method for correcting registration errors in three axes.

One embodiment of the rotary die apparatus includes a rotary die cylinder, a motor, a sensor, actuators, and a control system. The rotary die cylinder has an outer wall and a number of pattern protrusions extending from the outer wall to cut, emboss, or stamp a pattern onto a strip of material. The motor is coupled to the rotary die cylinder to rotate the rotary die cylinder. The sensor senses pre-defined fiducials on the strip of material and output signals including information about the fiducials. For example, the sensor may be a camera configured to capture and transmit image data regarding the fiducials. The actuators adjust the strip of material and/or the rotary die cylinder along an X-axis, along a Y-axis, and/or about a theta axis, wherein the X-axis extends along a direction of feed of the strip of material, the Y-axis extends transverse of the direction of feed of the strip of material, and the theta axis is an axis of rotation perpendicular to the X-axis and the Y-axis.

The control system receives signals from the sensor and calculates a registration error based on a difference between an actual location or orientation of the fiducials and a desired location or orientation of the fiducials. Then the control system outputs control signals to the actuators to adjust the rotary die cylinder while the rotary die cylinder continues to rotate. For example, the control system may command adjustment of the rotary die cylinder relative to the strip of material or the strip of material relative to the rotary die cylinder in accordance with the registration error along the X-axis, along the Y-axis, and/or about the theta axis. In some embodiments of the invention, the control system commands the actuators to adjust the rotary die cylinder or the strip of material for registration error only when pattern gaps (i.e., spaces between pattern protrusions) of the rotary die cylinder are facing the strip of material between pattern protrusions.

Another embodiment of the invention is a method for correcting registration error of a rotary die apparatus. The method includes the steps of actuating a rotary die and feeding a strip of material through the rotary die. Specifically, a rotary die cylinder with pattern protrusions and an anvil cylinder may be rotated in opposite rotational directions from each other continuously at a predetermined rotational speed. The strip of material may be cut, embossed, or stamped with a pattern when fed through the rotary die between the rotary die cylinder and the anvil cylinder. As the strip of material is fed through the rotary die, the method further includes the step of sensing fiducials on the strip of material and sending information from the sensor regarding the fiducials to the control system. Furthermore, the method may include the step of calculating a registration error based on a difference between an actual location or orientation of the fiducials and a desired location or orientation of the fiducials and then outputting control signals to actuators for adjusting the rotary die relative to the strip of material and/or the strip of material relative to the rotary die. Specifically, the registration error may include error amounts along an X-axis or direction of feed of the strip of material, along a Y-axis transverse to the X-axis, and rotationally about a theta axis that is perpendicular to the X-axis and the Y-axis. Thus, the actuators may adjust the rotary die in one or more of the X-, Y-, and theta-axes directions while the rotary die continues to rotate.

The summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 21:
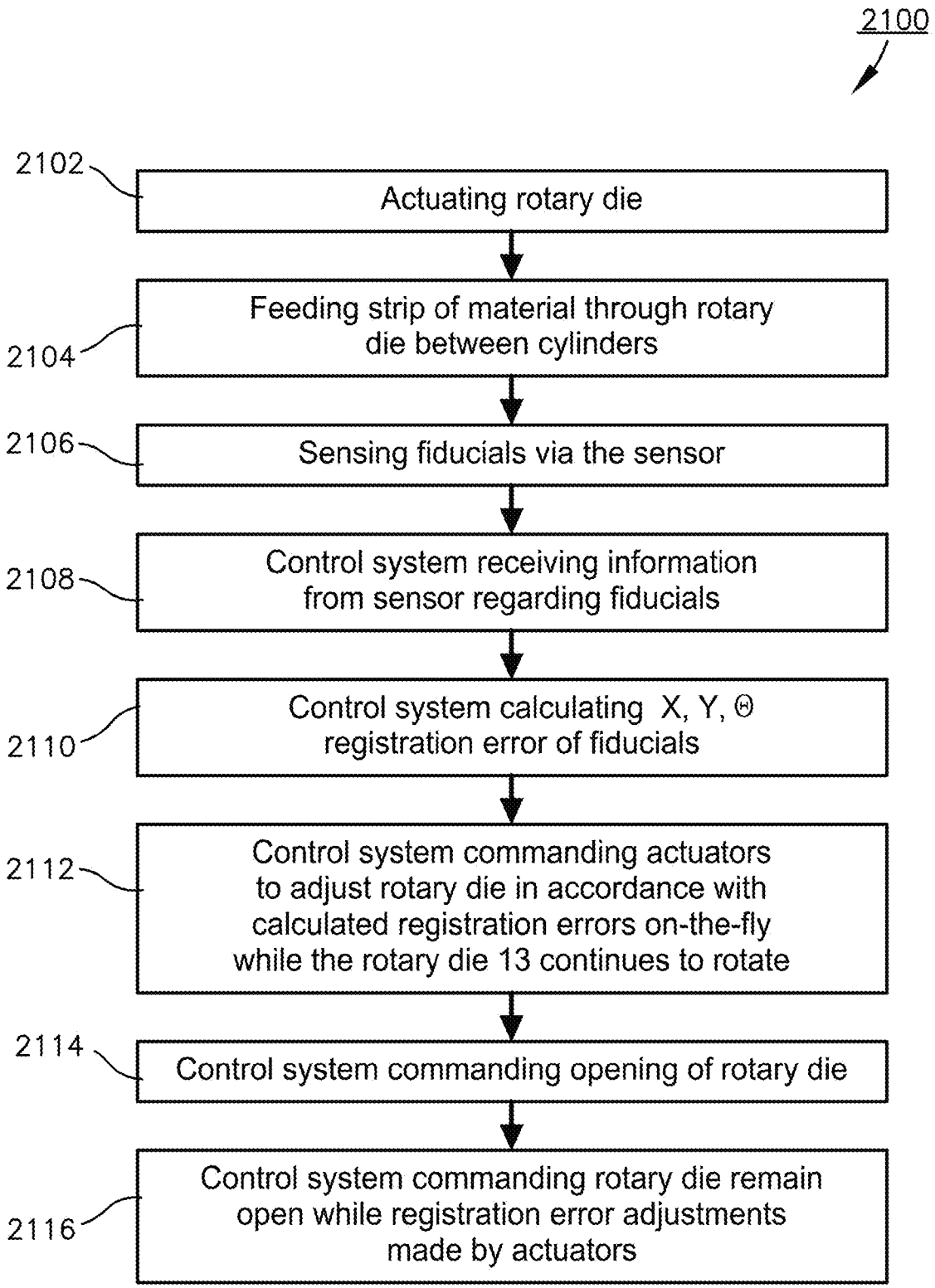
Figure 22:
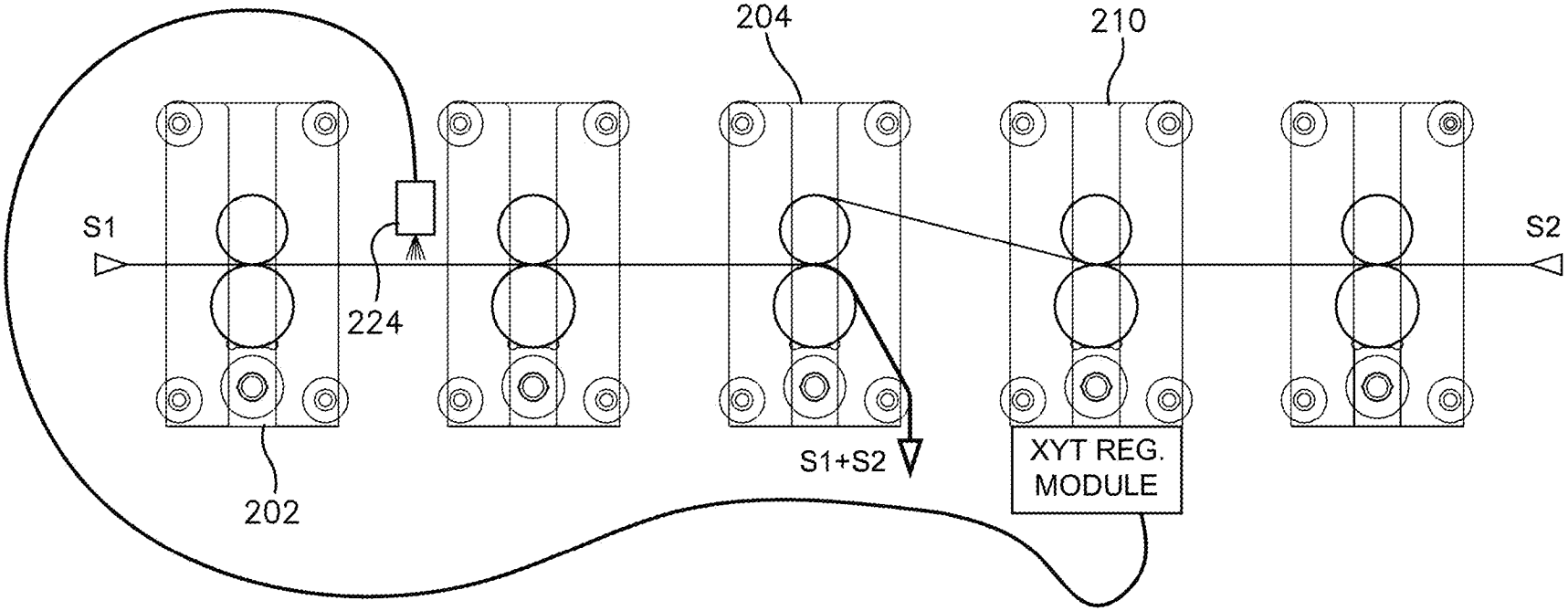

FIG. 21 is a flow chart illustrating a method for correcting registration error of a rotary die apparatus in three axes in accordance with embodiments of the present invention; and FIG. 22 is a schematic end view of multiple die stations, a fiducial sensor, and a lamination station constructed in accordance with an alternative embodiment of the invention The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Figure 1:
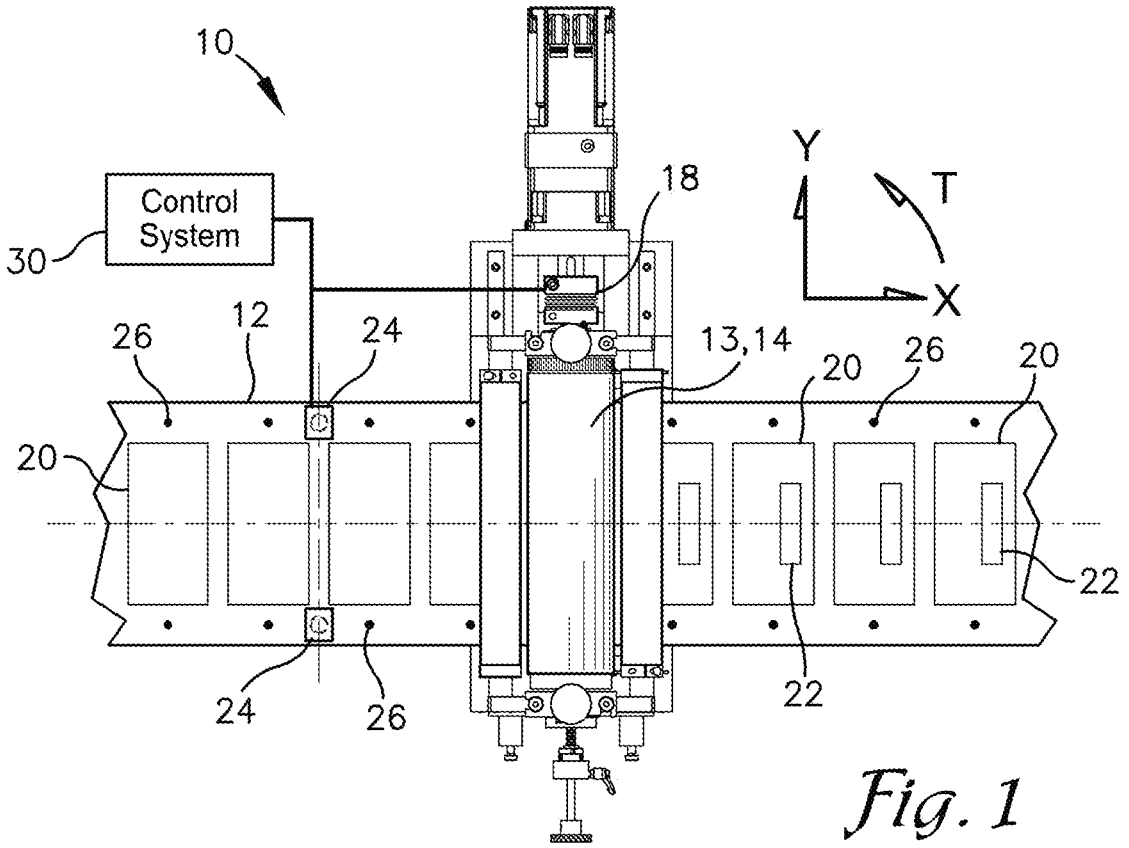
FIG. 1 is a plan view of a rotary die apparatus constructed in accordance with various embodiments of the present invention.
Figure 2:
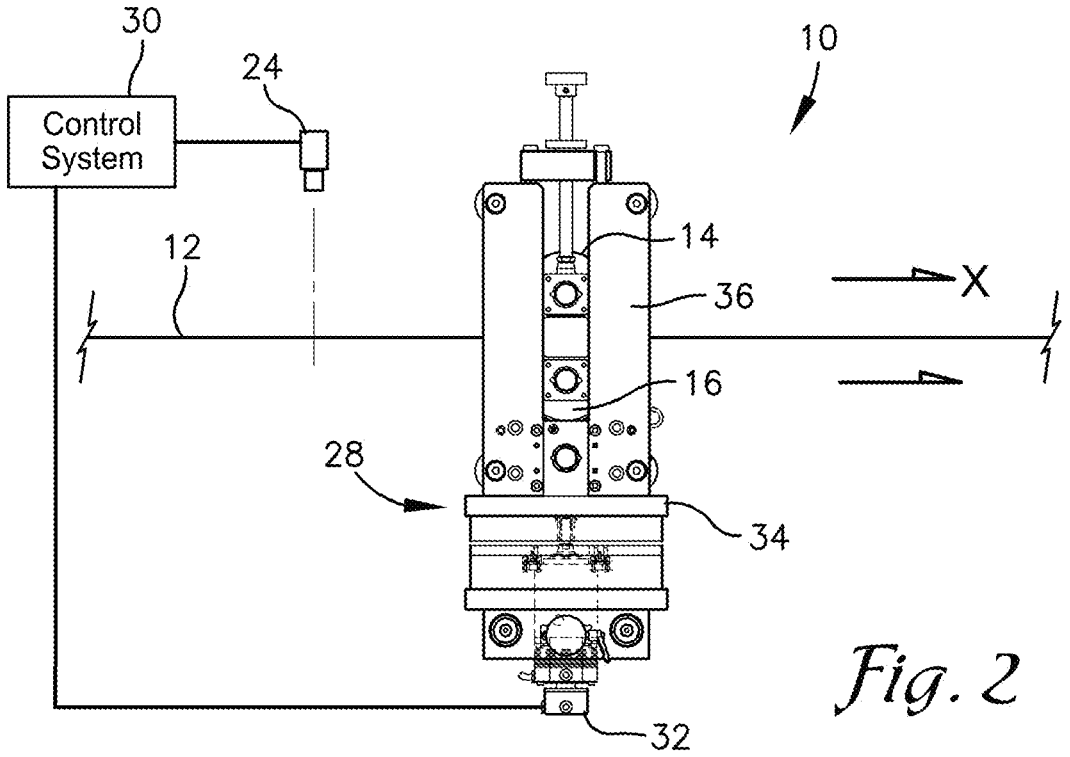
FIG. 2 is an end elevation view of the rotary die apparatus of FIG. 1.
Figure 3:
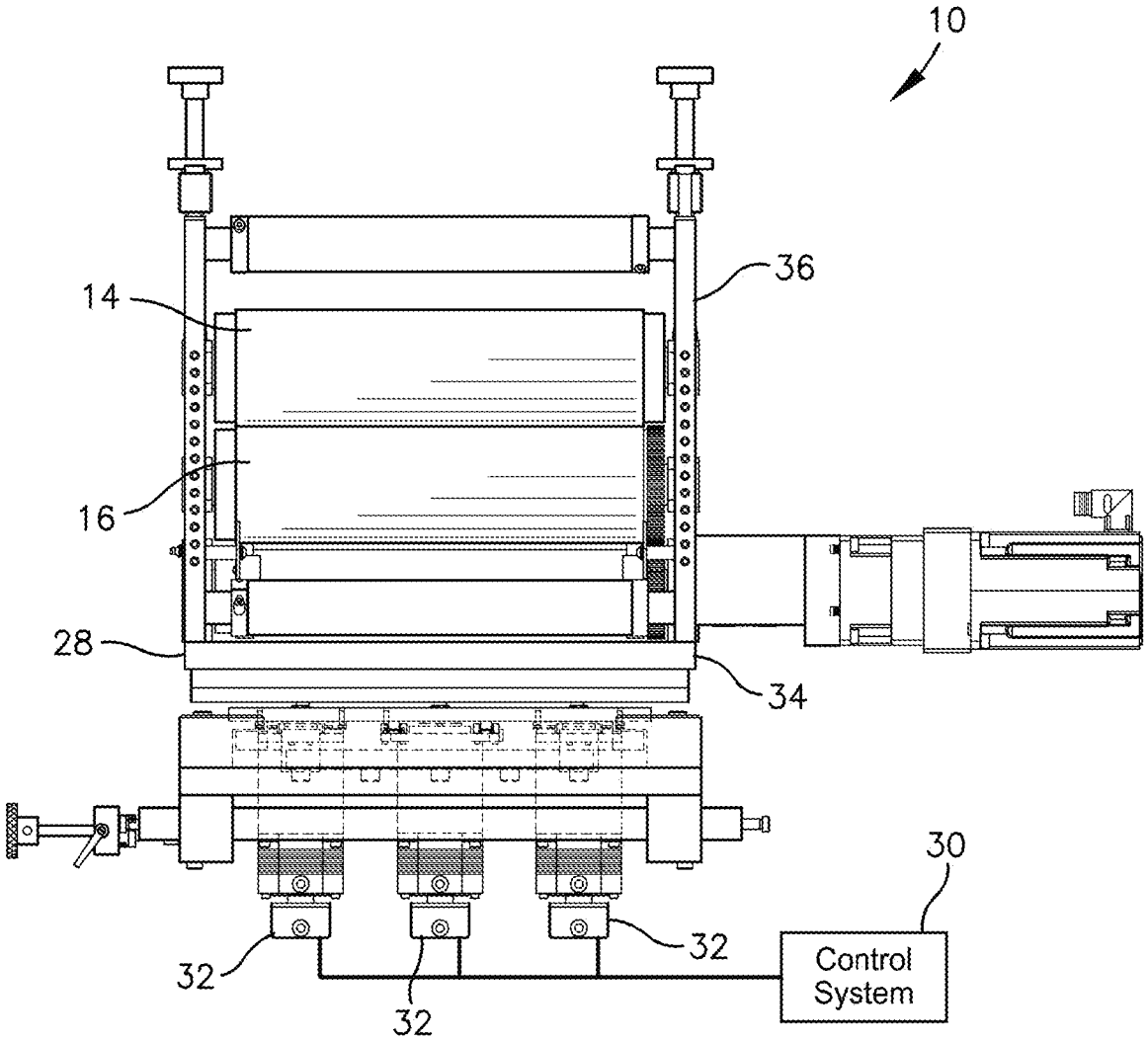
FIG. 3 is a side elevation view of the rotary die apparatus of FIG. 1.
Figure 4:
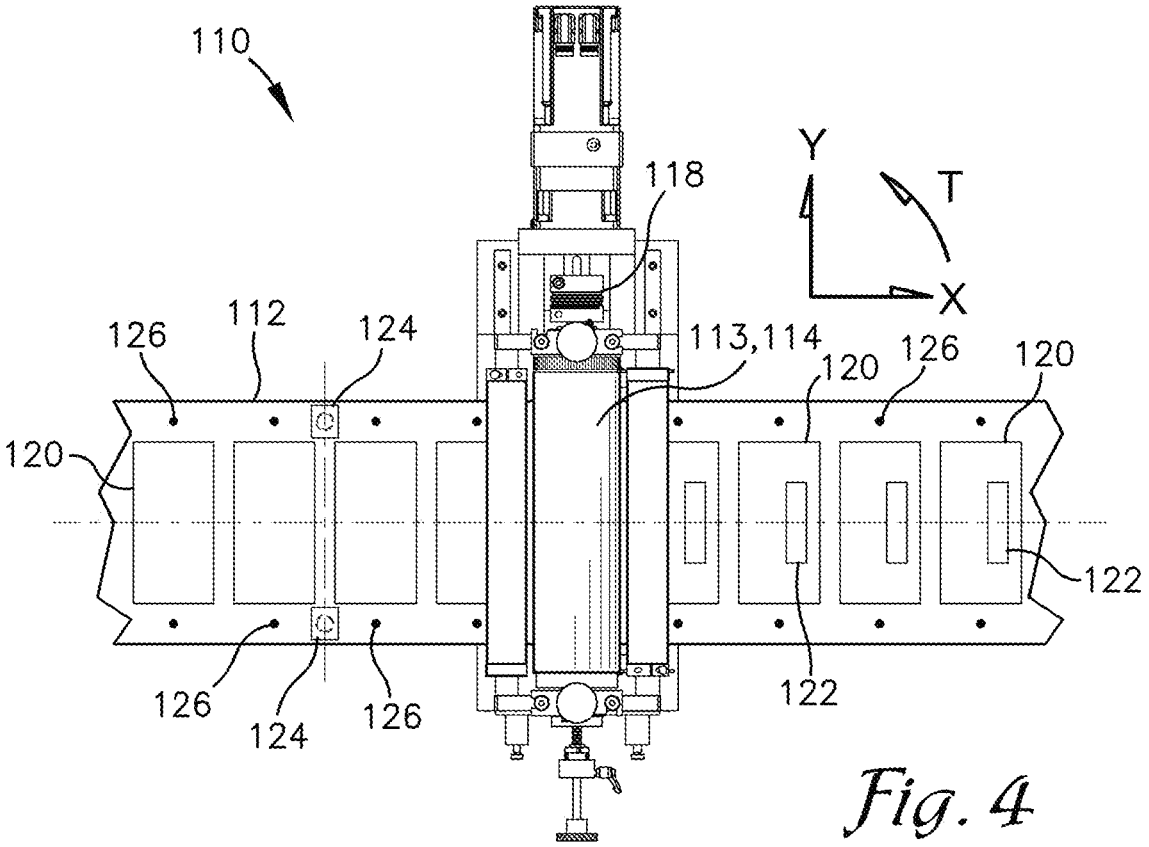
FIG. 4 is a plan view of a rotary die apparatus constructed in accordance with an alternative embodiment of the present invention.
Figure 5:
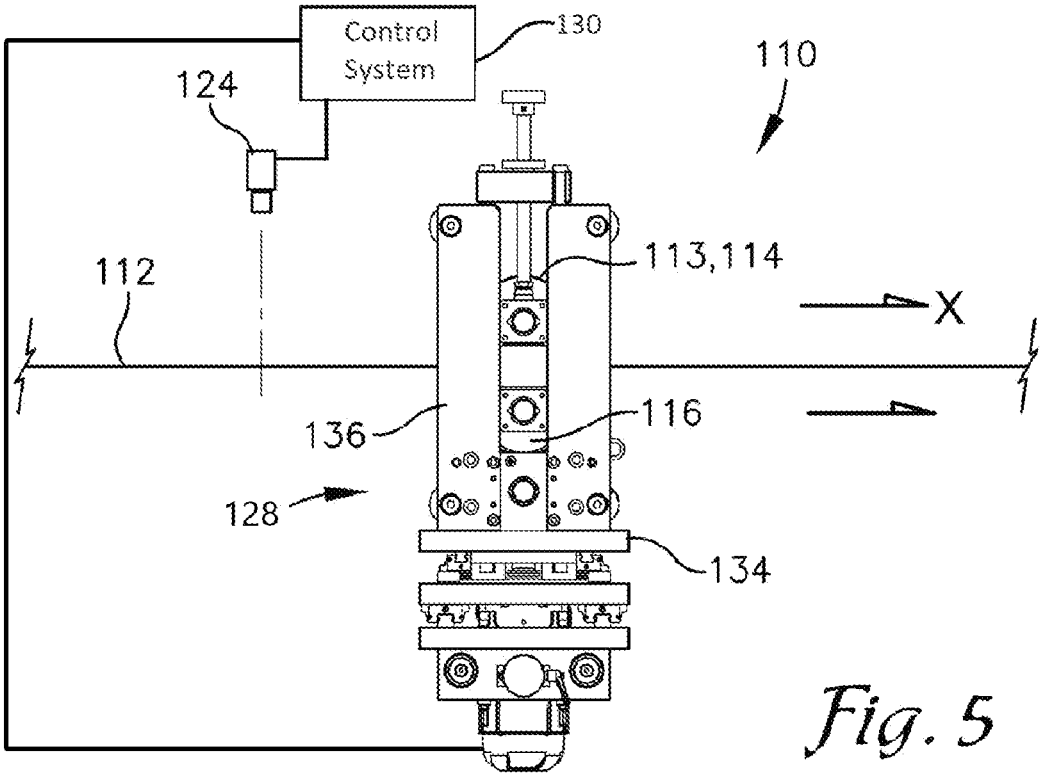
FIG. 5 is an end elevation view of the rotary die apparatus of FIG. 4.
Figure 6:
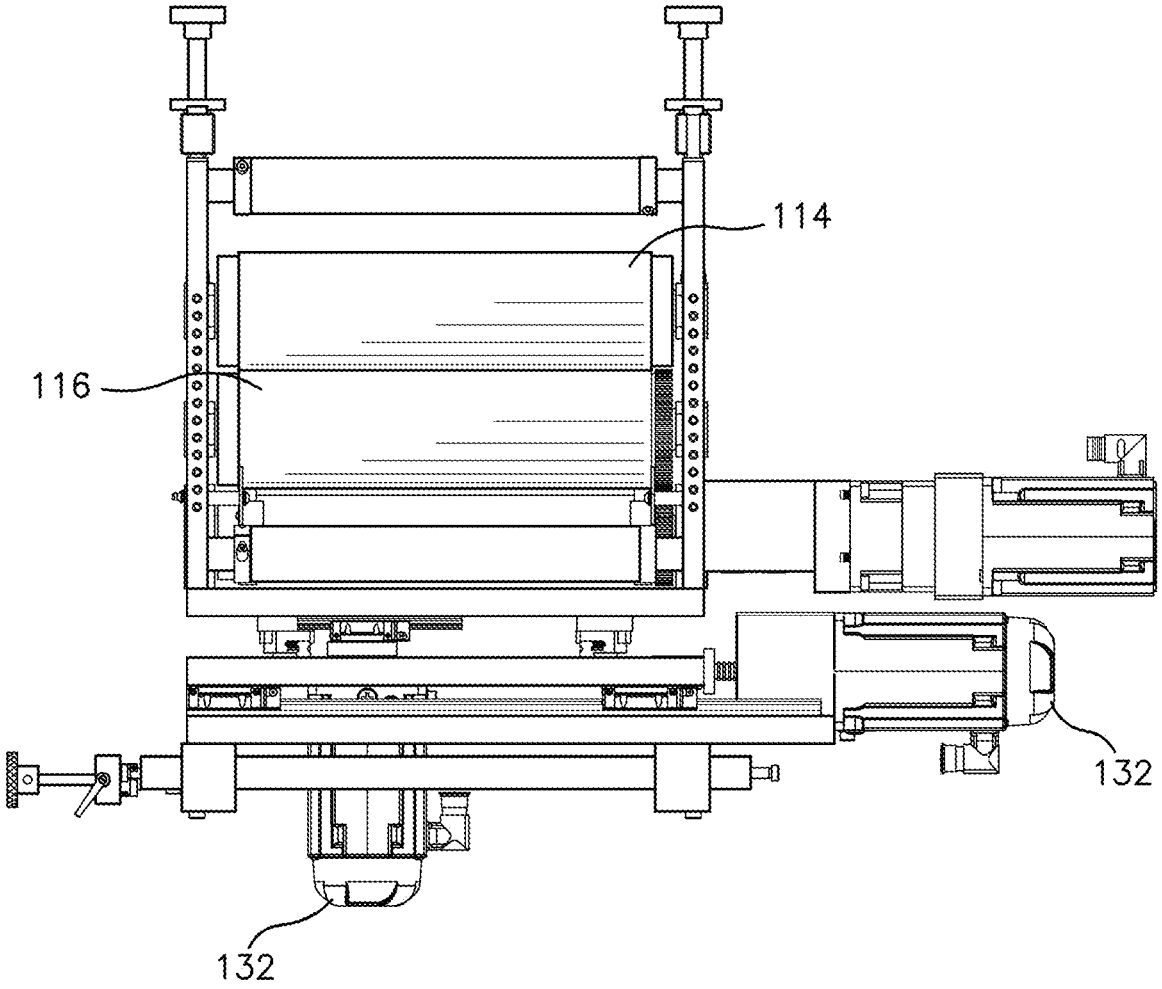
FIG. 6 is a side elevation view of the rotary die apparatus of FIG. 4.

Turning now to the drawing figures, a rotary die apparatus 10 constructed in accordance with embodiments of the invention is illustrated in FIGS. 1-3. The rotary die apparatus 10 may be used for cutting, embossing, or stamping one or more shapes or patterns into or onto a strip of material 12 at predefined intervals, as illustrated in FIGS. 1 and 2. The rotary die apparatus 10 may comprise a frame 28, a rotary die 13 having one or more rotary cylinders 14,16, a motor 18 or other drive mechanisms for rotating the rotary cylinders 14,16 at a fixed or variable speed, a sensor 24, a control system 30 and one or more actuators 32

The strip of material 12 may be any elongated piece of material known in the art. In some embodiments of the invention shown in FIGS. 1-2, the strip of material 12 may have a first layer with a sticky backing and a second layer onto which the first layer adheres to, such that the first layer may be pealed off of the second layer if desired. The strip of material 12 may have cuts, imprints, colors, patterns, various indicia, and/or fiducials 26 provided thereon. A fiducial, as defined herein, may be any type of reference marking or identifying feature on the strip of material that can be used as a reference point. For example, the fiducials 26 may be printed marks located proximate an edge of the strip of material 12 at predefined intervals. Alternatively, a particular color change on the strip of material or a particular design that can be sensed at regular intervals may also be used as a fiducial.

Although FIG. 1 illustrates the fiducials 26 as separate indicia located outside of the patterns 20,22, other configurations may be used without departing from the scope of the invention. In some embodiments of the invention, previously-applied patterns on the strip of material 12 may be used as the fiducials 26. For example, a first pattern 20 may be die cut into the strip of material 12, then a second pattern 22 may be aligned relative to the first pattern 20 on the strip of material 12. That is, the first pattern 20 may be sensed by the sensor 24 in order to determine alignment and/or registration error for the second pattern 22, as illustrated in FIG. 1. For example, as illustrated in FIG. 1, the first pattern 20 may be an outer rectangle pattern and the second pattern 22 may be an inner rectangle pattern registered to the first pattern 20 and thereby placed inside of the external rectangular pattern. Note that in some embodiments of the invention, both the first pattern 20 and the second pattern 22 may be cut by rotary dies or rotary die apparatuses substantially identical to the rotary die apparatus 10 described herein. Alternatively, the first pattern 20 could be applied by a 2-axis die station, lamination station, or other types of pattern-applying devices without departing from the scope of the invention.

Embodiments of the rotary die apparatus will now be described in more detail. The frame 28 may be any combination of fixed structural components configured for supporting the rotary cylinders 14,16. For example, the frame may include at least one base plate 34 and at least two flanges 36 fixed substantially perpendicular to the base plate 34 and parallel to each other. The rotary cylinders 14,16 may be positioned between and rotatably attached to the flanges 36 and/or on a rod extending between the flanges 36. The rotary cylinders 14,16 may be held in spaced relation to the base plate 34 and in spaced relation to each other by the flanges 36.

Figure 19:
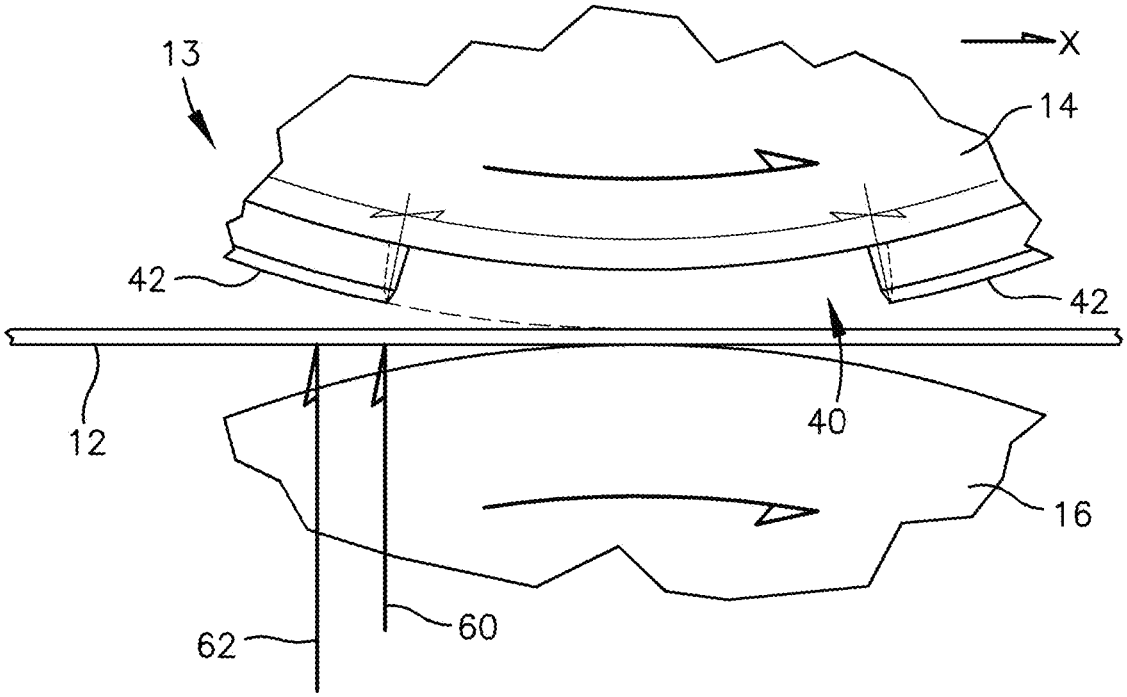
FIG. 19 is a fragmentary side elevation view of the rotary die apparatus of FIG. 1, illustrating a pattern protrusion on a rotary die cylinder before registration error correction.
Figure 20:
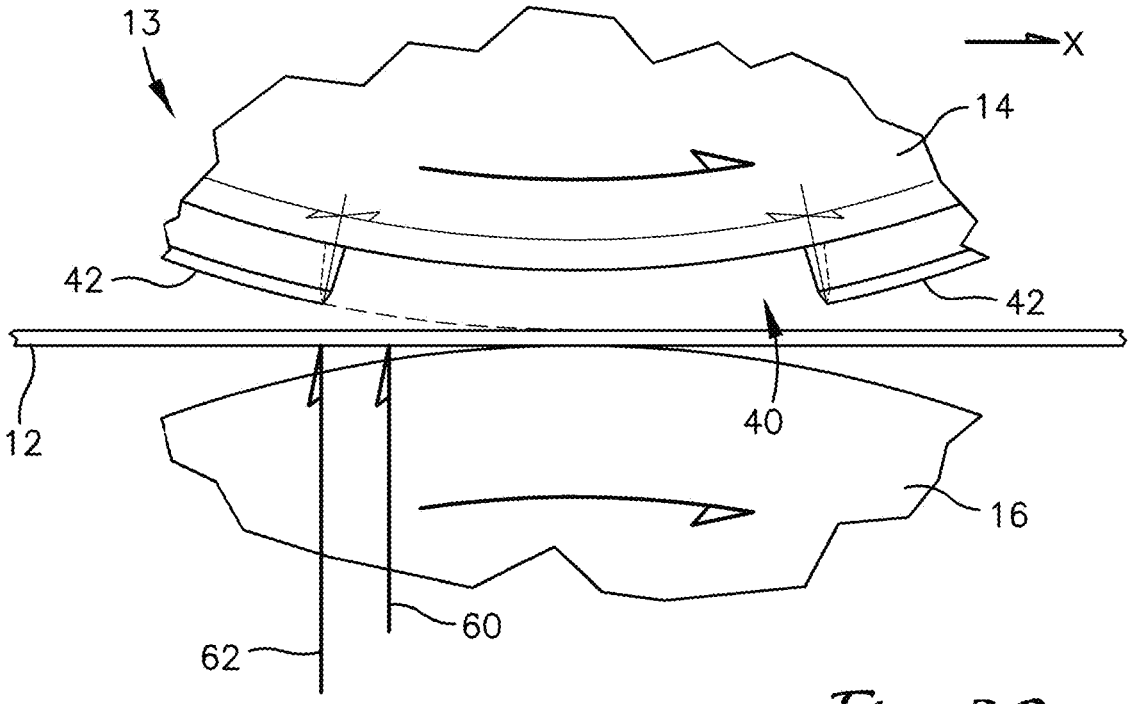
FIG. 20 is a fragmentary side elevation view of the rotary die apparatus of FIG. 19, illustrating the pattern protrusion on the rotary die cylinder after registration error correction.

The rotary die 13 may comprise one or more rotating cylinders, such as the rotary die cylinder 14 and anvil cylinder 16 illustrated in FIGS. 2-3. The cylinders 14,16 are configured for independently or cooperatively applying one or more patterns to the strip of material 12. Specifically, the two cylinders 14,16 may be positioned adjacent and substantially parallel with each other and may be configured to allow the strip of material 12 to be fed therebetween, as illustrated in FIG. 2. As illustrated in FIGS. 19-20, at least one of the cylinders 14,16 has an outer wall and one or more pattern protrusions 42 extending from the outer wall and configured for pattern cutting, embossing, or stamping. Each of the pattern protrusions may comprise one or more protrusions making up a single pattern, and the single pattern defined by each of the pattern protrusions may be repeated around a circumference of at least one of the cylinders 14,16. In some embodiments of the invention, the pattern protrusions may be configured to cut or partially cut one or more shapes or patterns into the strip of material 12. Alternatively, the cylinders 14,16 may emboss the strip of material 12 with one or more shapes or patterns, stamp one or more shapes or patterns onto the strip of material with ink or die, or completely sever a portion of the strip of material 12 therefrom.

In some embodiments of the invention, the anvil cylinder 16 has an outer wall with a solid outer surface or a number of inward depressions or cavities that inversely match the shape of the pattern protrusions on the rotary die cylinder 14. The rotary die cylinder 14 may be pressed into engagement with the anvil cylinder 16 to form either crush-cutting or shear-cutting nips therebetween. Alternatively, the rotary cylinders 14,16 may have any rotary die configurations known in the art.

The motor 18 may be one or more rotary motors or any device known in the art for actuating rotation of at least one of the rotary cylinders 14,16. The motor 18 may comprise any number of gears having pre-fabricated gear ratios and configured to transfer rotational movement of the motor 18 to at least one of the rotary cylinders 14,16. The motor 18, its gears, and/or the rotary cylinders 14,16 may be physically coupled with each other such that the motor 18 actuates one cylinder 14 of the rotary cylinders 14,16 to rotate in a first direction (e.g., counterclockwise) and actuates the other cylinder 16 of the rotary cylinders 14,16 to rotate in a second direction (e.g., clockwise). In some embodiments of the invention, the motor 18 may rotatably drive one cylinder 14 of the rotary cylinders 14,16, which may cooperatively actuate the other cylinder 16 of the rotary cylinders 14,16 to rotate in the opposing direction. In other embodiments of the invention, two separate motors may be used for the two separate rotary cylinders 14,16 of the rotary die 13. The motor 18 may additionally or alternatively include a drive electrically and/or communicably coupled with the control system 30 to control the motor's speed, direction, and/or an amount of power provided to the motor 18.

The sensor 24 may comprise any type of camera, optical sensor, color mark sensor, and/or any other device operable to detect the fiducials 26 printed or otherwise placed on the strip of material 12. As illustrated in FIGS. 1 and 2, the sensor 24 may include one or more sensors located in fixed locations above the strip of material 12, and may be used to sense one or more indicia or the fiducials 26 on the strip of material 12. Specifically, the sensor 24 may send a signal via wired or wireless communication devices known in the art to the control system 30 each time one of the fiducials 26 is sensed. Additionally or alternatively, an image of the fiducial may be transmitted to the control system 30 for analysis of its alignment in a plurality of directions. In some embodiments of the invention, the location of the sensor 24 may be such that each of the fiducials 26 is sensed slightly before it passes between the rotary cylinders 14,16. However, in some alternative embodiments of the invention, the location of the sensor 24 may be such that each of the fiducials 26 are sensed after they have passed between the rotary cylinders 14,16. The sensor 24 may also be positioned at and/or sense fiducials at any distance away from the rotary die 13. Furthermore, the sensor 24 may include a plurality of sensors or a single sensor that provides data indicating a plurality of variables related to the fiducial or fiducials 26, such that registration error and associated compensation required for all three above-referenced axes may be determined by the control system 30.

The control system 30 may comprise any number or combination of controllers, circuits, integrated circuits, programmable logic devices such as programmable logic controllers (PLC) or motion programmable logic controllers (MPLC), computers, processors, microcontrollers, or other control devices and residential or external memory for storing data and other information accessed and/or generated by the rotary die apparatus 10. The control system 30 may be coupled with the sensor 24, the motor 18, associated drives, the actuators 32, and/or other switches, sensors, and components through wired or wireless connections, such as a data bus (not shown), to enable information to be exchanged between the various components. The control system 30 may be configured to receive signals from the sensor 24 or related components, calculate a registration error along or about a plurality of axes, and command the actuators 32 and/or the motor 18 to take corrective action based on the calculated registration error for each pattern. The control system 30 may be configured to implement any combination of the algorithms, subroutines, or code described herein to calculate the registration error for each pattern or sensed fiducial.

The control system 30 and computer programs described herein are merely examples of computer equipment and programs that may be used to implement the present invention and may be replaced with or supplemented with other controllers and computer programs without departing from the scope of the present invention. The features of the control system 30 may be implemented in a stand-alone device, which is then interfaced to a rotary die apparatus or system. The control features of the present invention may also be distributed among the components of the rotary die apparatus 10. Thus, while certain features are described as residing in the control system 30, the invention is not so limited, and those features may be implemented elsewhere.

The control system 30 may implement a computer program and/or code segments to perform some of the functions and method described herein. The computer program may comprise an ordered listing of executable instructions for implementing logical functions in the control system 30. The computer program can be embodied in any computer-readable medium for use by or in connection with an instruction execution system, apparatus, or device, and execute the instructions. In the context of this application, a "computer-readable medium" can be any means that can contain, store, communicate, propagate, or transport the program for use by or in connection with the instruction execution system, apparatus, or device. The computer-readable medium can be, for example, but not limited to, an electronic, magnetic, optical, electro-magnetic, infrared, or semi-conductor system, apparatus, or device. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or Flash memory), an optical fiber, and a portable compact disk read-only memory (CDROM).

The control system 30 may be programmed or otherwise configured to determine a registration error relative to three different axes based on the signals received from the sensor 24. The term "registration error" may refer to an offset distance between where a particular pattern 20,22 should be applied to the strip of material 12 and the actual location where the pattern 20,22 will be or is being applied on the strip of material 12. Additionally or alternatively, the registration error may be a difference between an actual location or orientation of the fiducials 26 and a desired location or orientation of the fiducials. The registration error may be determined based on image analysis of images received from the sensor 24 or camera. Additionally or alternatively, the registration error may be determined based on data signals output by the sensor 24 and/or measurement devices associated therewith, such as rotary encoders or the like. At least one of the actuators 32 may be commanded by the control system 30 to adjust one or both of the rotary cylinders 14,16 along an X-axis, along a Y-axis, and/or about a theta axis T or θ-axis, based on the sensed registration error. As illustrated in FIGS. 1 and 2, the X-axis may be along a direction of feed or a direction of travel of the strip of material 12, the Y-axis may be transverse of the direction of feed or direction of travel of the strip of material 12, and the theta axis T, also referred to as a T-axis or θ-axis, may be an axis of rotation perpendicular to the X-axis and the Y-axis.

In some embodiments of the invention, a distance between patterns on the rotary die cylinder 14, referred to herein as a pattern gap 40 as illustrated in FIGS. 19-20, may be programmed into the control system 30, as well as speed and other variables, such that calculations may be made to determine at what point the real-time, on-the-fly adjustments described herein should be made along the X-axis, along the Y-axis, and/or about the theta axis. Specifically, it may be desirable to make adjustments to the rotary die 13 at points during rotation when the die cut patterns are not being applied to the strip of material 12. For example, if the fiducials 26 for a pattern are designed to align with a mid-point of each pattern, then the pattern gap 40 may be centered at a point mid-way between two sequential fiducials. Thus, adjustments may be made half the pattern gap before a point mid-way between two sequential fiducials and up to half the pattern gap after the point mid-way between the two sequential fiducials. In other embodiments of the invention, the fiducials 26 may be arranged to correspond directly with the pattern gaps 40 of the rotary die cylinder 14. Any relationship between the fiducials and the pattern gaps 40 may be established and/or programmed into the control system 30 without departing from the scope of the invention.

The actuators 32 may be used for adjusting alignment of the rotary die 13 relative to the strip of material 12 according to commands from the control system 30 which are determined by signals received from the sensor 24. The actuators 32 may include a three-crank adjustment mechanism, such as the illustrated on in FIGS. 1-3. Details of this mechanism are described in U.S. Pat. No. 7,640,836, incorporated by reference herein in its entirety. Specifically, the three-crank adjustment mechanism may have three crank arms, labeled M1, M2, and M3 in FIGS. 7-10, which may be driven by three motors or drives (not shown) in communication with the control system 30. One end of each of the crank arms M1, M2, and M3 may be attached to the frame 28. Each crank arm is associated with two types of motion: active rotation of the crank arm via its motor, and passive translation (sliding) of the individual crank arm to accommodate such frame 28 and/or base plate 34 movement.

Figure 7:
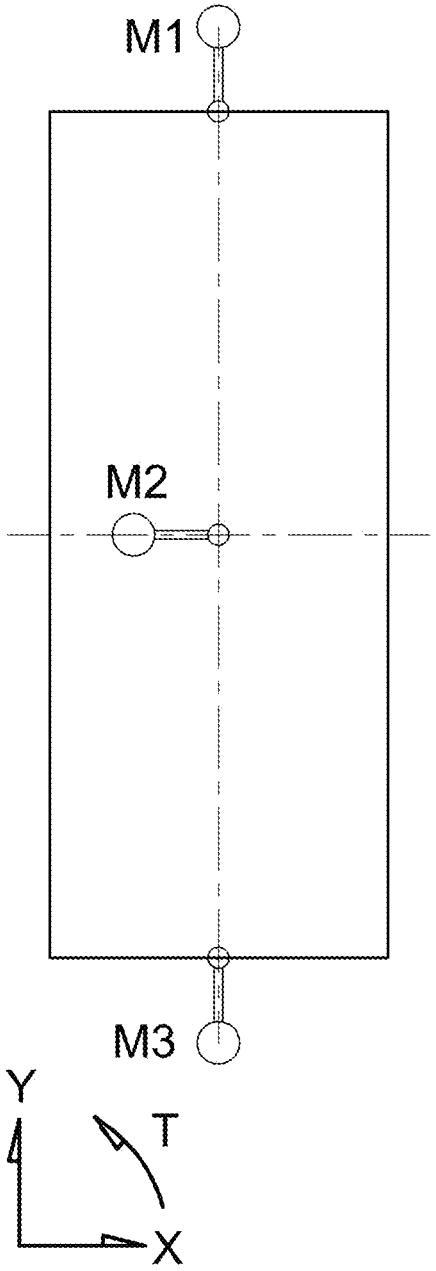
FIG. 7 is a schematic view of actuators for actuating a rotary die of the rotary die apparatus of FIG. 1.
Figure 8:
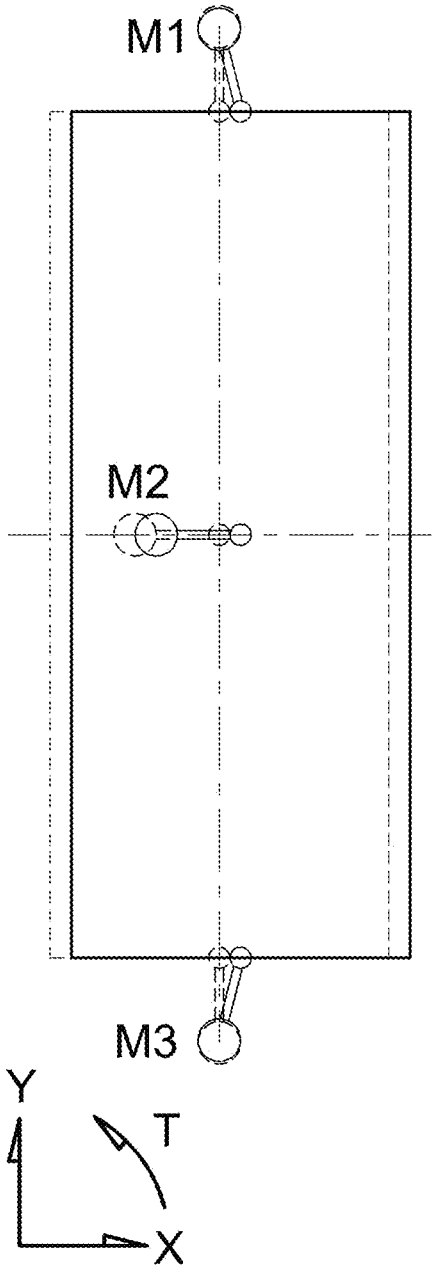
FIG. 8 is a schematic view of the actuators of FIG. 7 when actuated to move the rotary die along an X-axis.
Figure 9:
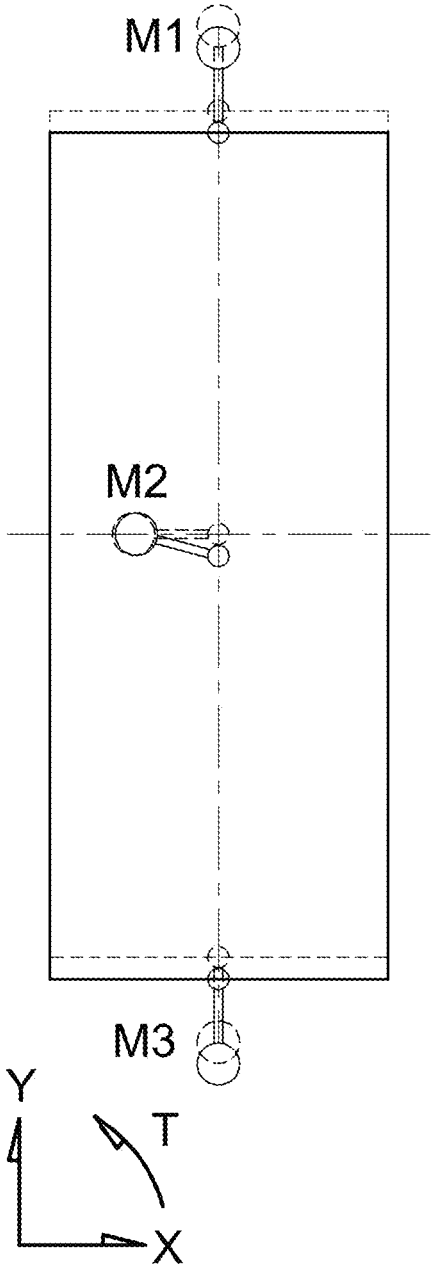
FIG. 9 is a schematic view of the actuators of FIG. 7 when actuated to move the rotary die along a Y-axis.
Figure 10:
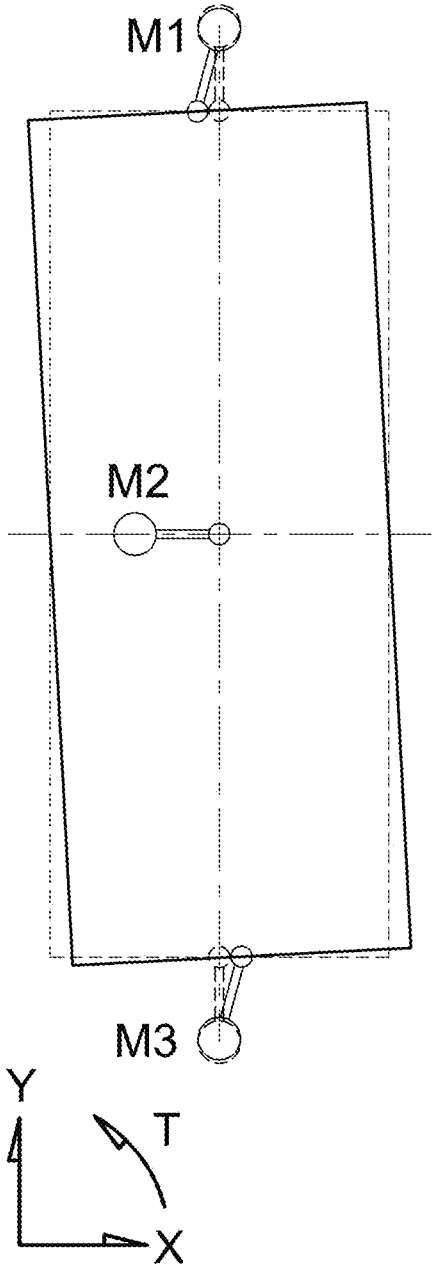
FIG. 10 is a schematic view of the actuators of FIG. 7 when actuated to move the rotary die rotationally about a theta axis.
Figure 11:
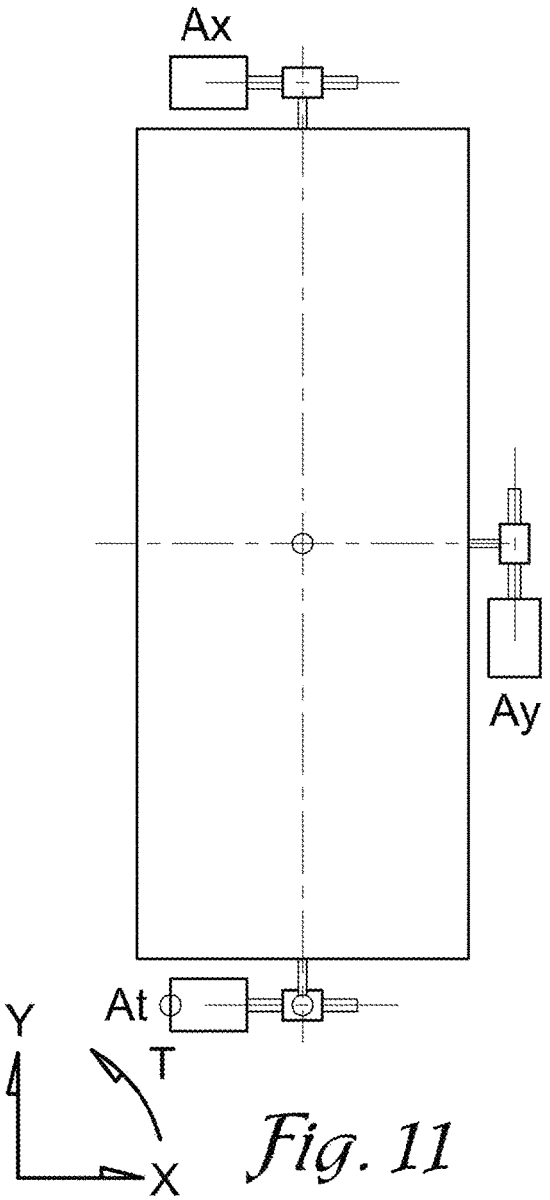
FIG. 11 is a schematic plan view of actuators for actuating a rotary die of the rotary die apparatus of FIG. 4.

As illustrated in FIG. 7, crank arms M1 and M3 are located at opposite side edges of the base plate 34 along the Y-axis, and crank arm M2 is located at a center of the base plate 34, mid-way between crank arms M1 and M3. As illustrated in FIG. 8, in order to adjust the rotary die 13 along the X-axis, the crank arms M1 and M3 may be rotated in opposite directions (one clockwise, the other counterclockwise) while crank arm M2 passively slides backwards or forwards along the X-axis. As illustrated in FIG. 9, in order to adjust the rotary die 13 along the Y-axis, the crank arms M1 and M3 may passively slide back or forth along the Y-axis while crank arm M2 is rotated clockwise or counter clockwise. Finally, as illustrated in FIG. 10, in order to rotatably adjust the rotary die 13 about the theta axis T, crank arm M2 may be held in place while crank arms M1 and M3 are both rotated clockwise or both rotated counterclockwise.

The actuators 32 may additionally or alternatively be replaced by and/or include traditional stand-alone actuators for independent adjustments, such as speed or direction adjustments of the web and/or the rotary die. For example, temporarily increasing or decreasing the rotary speed of the rotary cylinders 14,16 may be used to correct a registration error along the X-axis, as described in U.S. Pat. No. 8,910,570, incorporated by reference herein in its entirety. In other embodiments of the invention, feed mechanisms may increase or decrease the speed at which the strip of material 12 is fed through the rotary die 13.

The actuators 32 may also include manual or automated actuators for separating the rotary cylinders 14,16 laterally away from each other, thereby opening the rotary die 13. The control system 30 may command the rotary cylinders 14,16 be actuated away from each other and remain in this open configuration while the rotary die 13 and/or the strip of material 12 is adjusted by the actuators 32 along the X-axis, along the Y-axis, and/or about the theta axis to correct any registration error. This opening would be required to take place during the pattern gap 40, as described above. However, in other embodiments of the invention, opening or separating of the rotary cylinders 14,16 in order to make the registration error adjustments described herein may not be required.

A single strip of material may be substantially simultaneously or sequentially fed through multiple rotary die apparatuses, similar or identical to the rotary die apparatuses 10 described herein. For example, one of the rotary die apparatuses may apply a first pattern, and a next one of the rotary die apparatuses may apply a second pattern to the strip of material. In one embodiment of the invention, as illustrated in FIG. 22, a two-axis rotary die station 202 may be aligned with a lamination station 204 and a three-axis rotary die station 210, which may be substantially identical to the rotary die apparatus 10. Other mechanisms illustrated in FIG. 22 may include feed rollers and other conventional rotary die mechanisms. The lamination station 204 may laminate one strip of material S1 from the die station 202 to another strip of material S2 from the die station 210. Sensors 224 may be used to sense a first pattern formed on the material S1 by the die station 202. The first pattern may be used as a fiducial to determine registration misalignment of the die station 210, thereby ensuring that the separate patterns from the separate die stations 202 and 210 arrive on the strips of material S1, S2 to the lamination station 204 in proper alignment with each other.

Additionally or alternatively, a supplemental rotary die having supplemental pattern protrusions extending outward therefrom may be spaced apart from and aligned along the X-axis with the rotary die 13 described herein. The supplemental rotary die apparatus may have an X-axis, a Y-axis, and a theta axis and may be configured to cut, emboss, or stamp the pattern or a supplemental pattern onto the strip of material. The supplemental rotary die may be moveable along these axes via supplemental actuators. The supplemental actuators may be configured to receive signals from a supplemental control system or the control system 30 to independently adjust the supplemental rotary die relative to the strip of material or to independently adjust the strip of material relative to the supplemental rotary die. For example, the supplemental actuators may adjust the supplemental rotary die at least one of: along the X-axis, along the Y-axis, and about the theta axis of the supplemental rotary die using any of the actuation techniques described herein.

In some embodiments of the invention, the rotary die apparatus 10 may also comprise feeding mechanisms (not shown) such as pairs of rollers presented forward of and/or aftward of the rotary die 13 for cooperatively nipping, tensioning, and/or feeding the strip of material 12 in contact with the rotary die 13. The invention may include these and other conventional components of rotary die apparatuses without departing from the scope of the invention.

Operation of the rotary die apparatus will now be described in more detail. The strip of material 12 with the plurality of spaced apart fiducials 26 is fed between the rotary cylinders 14,16. When the sensor 24 detects one of the fiducials 26, the control system 30 uses data and/or images received from the sensor to determine the registration error. The rotary cylinders 14,16 can then be adjusted by a desired amount to correct this calculated registration error along the X-axis, along the Y-axis, and/or about the theta axis T. The timing of such adjustments may be determined based on a number of variables such as the pattern gap 40, rotational speed of the rotary cylinders 14,16, and other variables programmed into the control system 30, so that the adjustments may be made on-the-fly, while the rotary die 13 continues to operate, but between patterns, so as not to negatively affect a pattern being applied to the strip of material 12.

The flow chart of FIG. 21 depicts the steps of an exemplary method 2100 for correcting registration error along or about three separate axes during continuous rotary die operation in more detail. Some of the steps of the method may be implemented with the control system 30, its computer programs, and/or other components of the rotary die apparatus 10, such as the actuators 32 and/or the motor 18. In some alternative implementations, the functions noted in the various blocks may occur out of the order depicted in FIG. 21. For example, two blocks shown in succession in FIG. 21 may in fact be executed substantially concurrently, or the blocks may sometimes be executed in the reverse order depending upon the functionality involved.

The method 2100 may include a step of actuating the rotary die 13, as depicted in block 2102. This may include rotating the rotary die cylinder 14 and/or the anvil rotary die 16 continuously at a predetermined rotational speed via turning on the motor 18. As noted above, the speed of the motor may be controlled by the control system 30 and/or may be a fixed speed without departing from the scope of the invention.

Next, the method 2100 may include a step of feeding a strip of material through the rotary die 13 between the cylinders 14,16, as depicted in block 2104. This may be accomplished via feed rollers, manually feeding, and/or the actuation of the rotary die 13. The strip of material 12 may thus be cut, printed, embossed, or stamped with a pattern when fed through the rotary die 13.

The method 2100 may further include the steps of sensing the fiducials 26, as depicted in block 2106, via the sensor 24, and the control system receiving information from the sensor 24 regarding the fiducials 26, as depicted in block 2108. The fiducials 26 on the strip of material 12 may be sensed, filmed, photographed, or otherwise recorded as the strip of material 12 is fed through the rotary die 13. For example, a camera may be used to record and send images to the control system 30 for comparison to previously-stored images, programmed or stored variables, and/or other programmed or sensed information.

Next, the method 2100 may include a step of the control system 30 calculating a registration error of the fiducials 26, as depicted in block 2110, based on a difference between an actual location or orientation of the fiducials 26 and a desired location or orientation of the fiducials 26. The registration error may include registration error amounts along an X-axis, along a Y-axis, and about a theta axis. Then, the method 2100 may include a step of outputting control signals from the control system 30 to the actuators 32, as depicted in block 2112. Specifically, the control signals may command the actuators 32 to adjust both cylinders 14,16 of the rotary die 13 relative to the strip of material 12 in accordance with the registration error calculated along the X-axis, along the Y-axis, and/or about the theta axis on-the-fly while the rotary die 13 continues to rotate. Additionally or alternatively, the registration error calculated along the X-axis may be corrected by actuation of the strip of material 12 relative to the rotary die 13, while the registration error of the Y-axis and the theta axis may still be controlled via actuation of the rotary die 13 along the Y-axis and/or about the theta axis.

In some embodiments of the invention, the control system 30 may command the actuators 32 to adjust the rotary die 13 for registration error correction only when the pattern gaps 40 of the rotary die cylinder 14 are facing the strip of material 12 between pattern protrusions 42. Likewise, registration error correction along the X-axis via the speed of the rotary die 13 or the speed of the strip of material 12 may only be adjusted for registration error correction during the pattern gaps 40 of the rotary die cylinder 14. FIGS. 19-20 illustrate the pattern gap 40 between two pattern protrusions 42, with FIG. 19 illustrating a cut location 60 of the pattern protrusion 42 prior to registration error correction via the actuators 32, and FIG. 20 illustrating a cut location 62 of the pattern protrusion 42 following registration error correction along the X-axis via the actuators 32.

In some alternative embodiments of the invention, the method may include a step of the control system 30 commanding opening of the anvil cylinder 16 and the rotary die cylinder 14 laterally away from each other along the theta axis, as depicted in block 2114, and commanding the rotary die 13 to remain open while registration error adjustments are made by the actuators 32, as depicted in block 2116.

In an alternative embodiment of the invention, as illustrated in FIGS. 4-6 and 11-18, a rotary die apparatus 110 may be substantially identical to the rotary die apparatus 10. Specifically, the rotary die apparatus 110 may include a frame 128, a rotary die 113 having rotary cylinders 114,116, a motor 118, a sensor 124, and a control system 130, each similar or substantially identical to the frame 28, the rotary die 13 having rotary die cylinders 14,16, the motor 18, the sensor 24, and the control system 30, respectively, as described above. The rotary die 113 may be used to create patterns, such as patterns 120 and 122, on a strip of material 112, substantially similar or identical to the strip of material 12 described above.

However, the rotary die apparatus 110 may alternatively include actuators 132 having a stacked X-Y-T mechanism with three moveable frames, labeled St, Sy, and Sx respectively in FIGS. 12, 14, 16, and 18. These moveable frames may be stacked together and selectively movable relative to a fixed surface Sf and relative to each other via motors or actuators At, Ay, and Ax, as illustrated in FIGS. 11, 13, 15, and 17. For example, the frame 128 of the rotary die apparatus 110 may be fixed to or integrally formed with the moveable frame St. The moveable frame St may be attached to the moveable frame Sy via a pivot 138 fixed to and extending from a surface of movable frame Sy. The moveable frame St may be selectively rotatable about the pivot 138. The moveable frames Sy and Sx may be fixed in spaced apart relation with each other, and the moveable frame Sx may be slidably attached to the fixed surface Sf along the X-axis and along the Y-axis.

Figure 13:
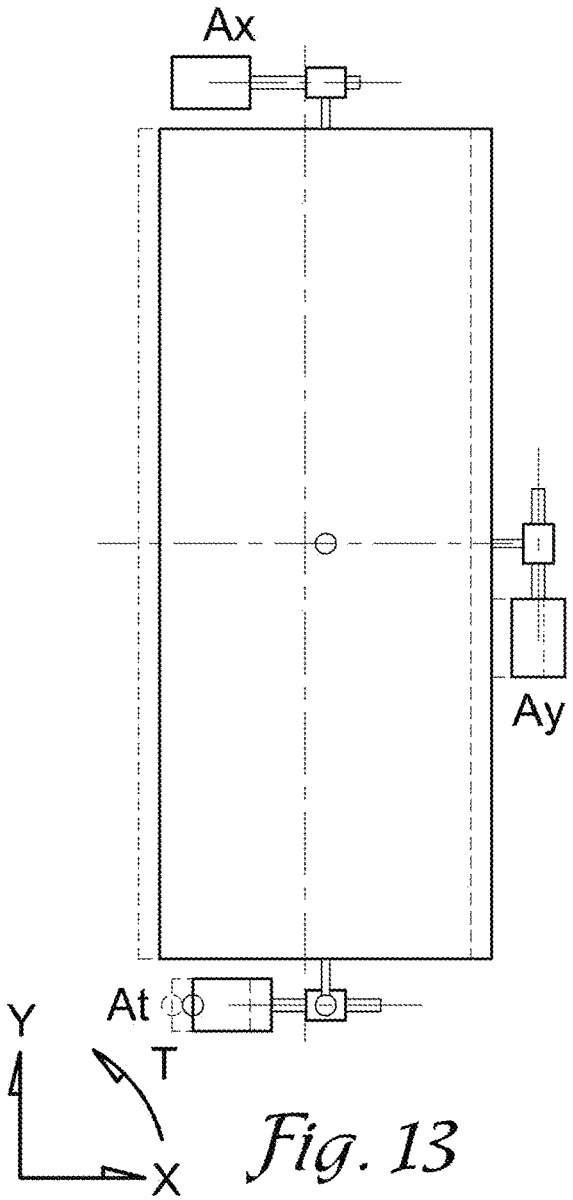
FIG. 13 is a schematic plan view of the actuators of FIG. 11 when actuated to move the rotary die along an X-axis.
Figure 12:
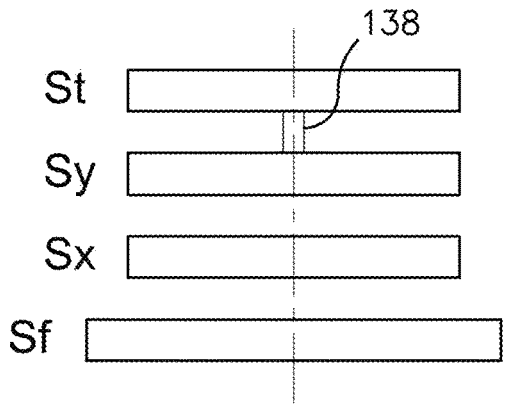
FIG. 12 is a schematic end view of the actuators of FIG. 11.
Figure 14:
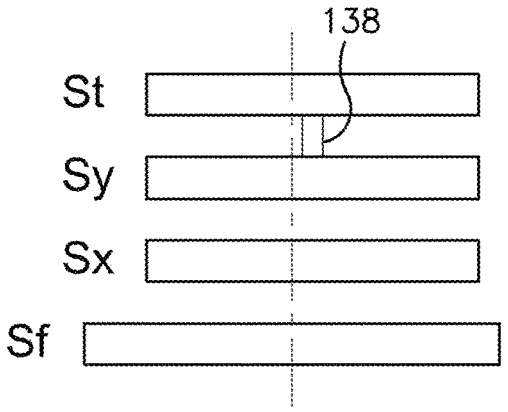
FIG. 14 is a schematic end view of the actuators of FIG. 13 actuated along the X-axis.
Figure 15:
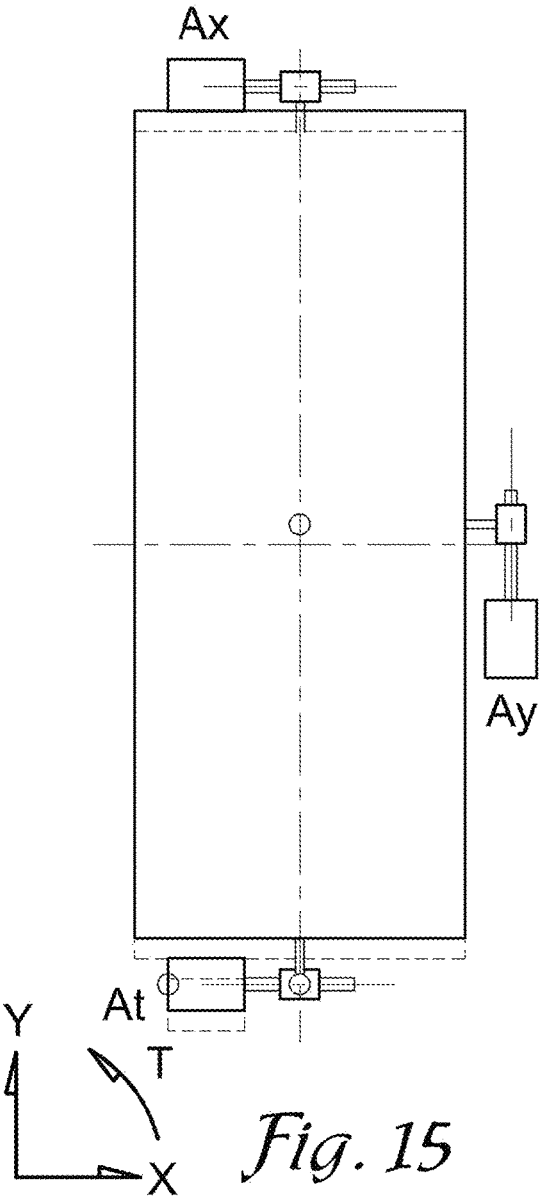
FIG. 15 is a schematic plan view of the actuators of FIG. 11 when actuated to move the rotary die along a Y-axis.
Figure 17:
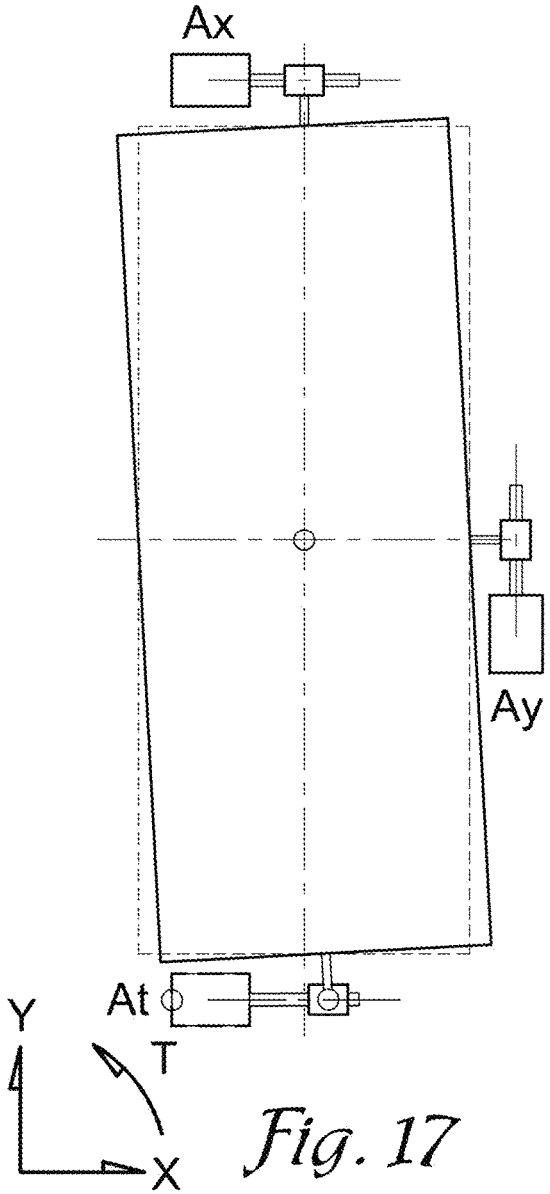
FIG. 17 is a schematic plan view of the actuators of FIG. 11 when actuated to rotate the rotary die about a theta axis.
Figure 16:
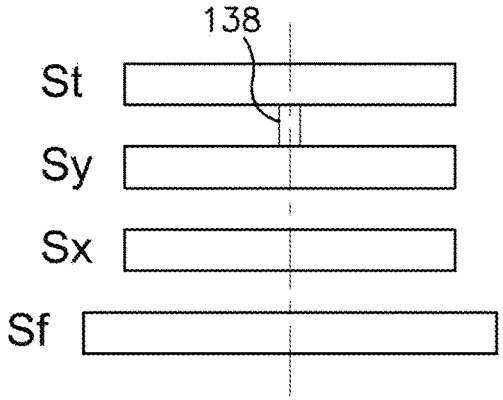
FIG. 16 is a schematic end view of the actuators of FIG. 15 actuated along the Y-axis.
Figure 18:
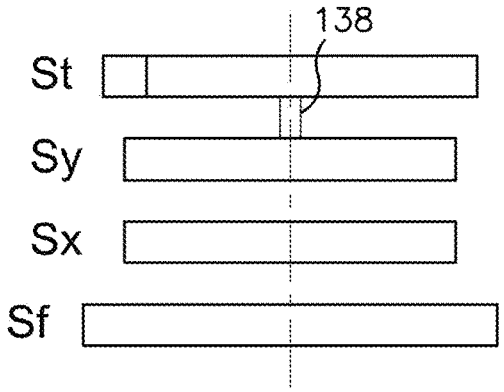
FIG. 18 is a schematic end view of the actuators of FIG. 17 actuated about the theta axis.

As illustrated in FIGS. 13-14, in order to adjust the rotary die 113 along the X-axis, the control system 130 may command the actuator Ax to slide the moveable frame Sx forward or aftward along the X-axis, while moveable frames Sy and St remain fixed relative to each other and relative to the moveable frame Sx, thereby also moving along the X-axis with the moveable frame Sx. As illustrated in FIGS. 15-16, in order to adjust the rotary die 113 along the Y-axis, the control system 130 may command the actuator Ay to slide the moveable frame Sy back or forth along the Y-axis, while moveable frame Sx remains fixed to Sf and St remains fixed relative to the moveable frame Sy, thereby also moving along the Y-axis with the moveable frame Sy. As illustrated in FIGS. 17-18, in order to adjust the rotary die 113 rotatably about the theta axis T, the control system 130 may command the actuator At to rotate the moveable frame St clockwise or counterclockwise about the pivot 138. This has no effect on moveable frames Sy and Sx, which may remain fixed relative to each other and relative to the fixed surface Sf. In some embodiments of the invention, any combination of the actuators Ax, Ay, and At may be simultaneously actuated in order to adjust the rotary die 113 along or about multiple ones of the X-axis, Y-axis, and theta axis T.

Although the invention has been described with reference to the preferred embodiment illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A rotary die apparatus comprising:

a rotary die cylinder having an outer wall and pattern protrusions extending from the outer wall and configured to cut, emboss, or stamp a pattern onto a strip of material, the rotary die cylinder defining a longitudinal axis;

a motor operably connected to the rotary die cylinder for rotating the rotary die cylinder about the longitudinal axis;

a sensor configured to sense one or more pre-defined fiducials on the strip of material and to output a signal including information regarding at least one of the fiducials;

one or more actuators operably connected to the rotary die cylinder and drivable to translate the rotary die cylinder along an X-axis, translate the rotary die cylinder along a Y-axis, and rotate the rotary die cylinder about a theta axis, wherein the X-axis is along a material feed direction of the rotary die apparatus, wherein the Y-axis is transverse of the material feed direction, and the theta axis is an axis of rotation perpendicular to the X-axis and the Y-axis; and a control system operably connected to the sensor and to the one or more actuators, the control system being configured to receive signals from the sensor, calculate a registration error based on a difference between an actual location or orientation of the fiducials and a desired location or orientation of the fiducials, and output control signals to the one or more actuators to adjust the rotary die cylinder relative to the strip of material in accordance with the registration error calculated at least one of: along the X-axis, along the Y-axis, and about the theta axis while the rotary die cylinder continues to rotate about its longitudinal axis.

2. The rotary die apparatus of claim 1, further including an anvil cylinder that cooperates with the rotary die cylinder, wherein the pattern protrusions are circumferentially spaced apart from each other about the rotary die cylinder by a pattern gap, wherein the control system commands the one or more actuators to adjust the rotary die cylinder only when the pattern gap of the rotary die cylinder is facing the anvil cylinder.

3. The rotary die apparatus of claim 1, further comprising an anvil cylinder that rotates in an opposite direction than the rotary die cylinder and is physically coupled with the rotary die cylinder to be cooperatively actuated with the rotary die cylinder at least one of: along the X-axis, along the Y-axis, and about the theta axis.

4. The rotary die apparatus of claim 3, wherein the anvil cylinder and the rotary die cylinder are supported to open by being actuated laterally away from each other, and to remain open while at least one of the rotary die cylinder and the anvil cylinder are adjusted by the one or more actuators at least one of: along the X-axis, along the Y-axis, and about the theta axis.

5. The rotary die apparatus of claim 1, wherein the registration error includes an X-axis registration error along the X-axis, a Y-axis registration error along the Y-axis, and a theta axis registration error about the theta axis.

6. The rotary die apparatus of claim 1, wherein the sensor is a camera.

7. The rotary die apparatus of claim 1, wherein the one or more actuators includes a three-crank adjustment mechanism that selectively translates the rotary die cylinder along the X-axis, translates the rotary die cylinder along the Y-axis, and rotates the rotary die cylinder about the theta axis according to the registration error calculated.

8. The rotary die apparatus of claim 1, wherein the actuators include a stacked X-Y-T mechanism having three moveable frames that selectively translate the rotary die cylinder along the X-axis, translate the rotary die cylinder along the Y-axis, and rotate the rotary die cylinder about the theta axis according to the registration error calculated.

9. A method of correcting registration error of a rotary die apparatus, the method comprising the steps of:

actuating a rotary die comprising a rotary die cylinder and an anvil cylinder, wherein the actuating includes rotating the rotary die cylinder, having pattern protrusions extending from an outer wall, in an opposite rotational direction of the anvil cylinder continuously at a predetermined rotational speed;

feeding a strip of material through the rotary die between the rotary die cylinder and the anvil cylinder, wherein the strip of material is cut, embossed, or stamped with a pattern when fed through the rotary die;

sensing, with a sensor, fiducials on the strip of material as the strip of material is fed through the rotary die;

receiving, with a control system, information from the sensor regarding the fiducials;

calculating, with the control system, a registration error based on a difference between an actual location or orientation of the fiducials and a desired location or orientation of the fiducials, wherein the registration error may include error amounts along an X-axis, along a Y-axis, and about a theta axis, wherein the X-axis is along a direction of feed of the strip of material, wherein the Y-axis is transverse of the direction of feed of the strip of material, and the theta axis is an axis of rotation perpendicular to the X-axis and the Y-axis;

outputting control signals from the control system to one or more actuators, wherein the or more actuators are operably connected to the rotary die and drivable to translate the rotary die along an X-axis, translate the rotary die along a Y-axis, and rotate the rotary die about a theta axis, and wherein the control signals command the one or more actuators to adjust the rotary die relative to the strip of material in accordance with the registration error calculated at least one of: along the X-axis, along the Y-axis, and about the theta axis while the rotary die continues to rotate.

10. The method of claim 9, wherein the pattern protrusions are circumferentially spaced apart from each other about the rotary die cylinder by a pattern gap, wherein the control system commands the one or more actuators to adjust the rotary die only when the pattern gap of the rotary die cylinder is facing the strip of material between pattern protrusions.

11. The method of claim 9, further comprising the control system commanding the one or more actuators to open the anvil cylinder and the rotary die cylinder laterally away from each other and to remain open while the rotary die is adjusted by the one or more actuators at least one of: along the X-axis, along the Y-axis, and about the theta axis.

12. The method of claim 9, wherein the sensor is a camera that sends an image of the fiducial to the control system.

13. The method of claim 9, wherein the one or more actuators include a three-crank actuator that selectively shifts the rotary die along the X-axis, along the Y-axis, and about the theta axis according to the registration error calculated.

14. The method of claim 9, wherein the one or more actuators include a stacked X-Y-T mechanism having three moveable frames that selectively shift the rotary die along the X-axis, along the Y-axis, and about the theta axis according to the registration error calculated.

15. A rotary die apparatus comprising:

a rotary die comprising a rotary die cylinder and an anvil cylinder each defining a longitudinal axis, wherein the rotary die cylinder has an outer wall and pattern protrusions extending from the outer wall and configured to cut, emboss, or stamp a pattern onto a strip of material being fed between the rotary die cylinder and the anvil cylinder while the rotary die cylinder rotates about its longitudinal axis in an opposite direction than the anvil cylinder, wherein the pattern protrusions are circumferentially spaced apart from each other about the rotary die cylinder by a pattern gap;

a motor operably connected to at least one of the rotary die cylinder and the anvil cylinder to rotate the at least one of the rotary die cylinder and the anvil cylinder;

a camera configured to capture and output image data of one or more fiducials on the strip of material;

one or more actuators operably connected to the rotary die and drivable to translate the rotary die along an X-axis, translate the rotary die along a Y-axis, and rotate the rotary die about a theta axis, wherein the X-axis is along a material feed direction of the rotary die apparatus, wherein the Y-axis is transverse of the material feed direction, and the theta axis is an axis of rotation perpendicular to the X-axis and the Y-axis; and a control system operably connected to the camera and to the one or more actuators, the control system being configured to receive image data from the camera, calculate a registration error based on a difference between an actual location or orientation of the fiducials and a desired location or orientation of the fiducials, and output control signals to the one or more actuators to adjust the rotary die relative to the strip of material in accordance with the registration error calculated at least one of: along the X-axis, along the Y-axis, and about the theta axis while the rotary die cylinder continues to rotate about its longitudinal axis, wherein the control system commands the one or more actuators to adjust the rotary die only when the pattern gap of the rotary die cylinder is facing the anvil cylinder.

16. The rotary die apparatus of claim 15, wherein the one or more actuators include a three-crank adjustment mechanism that selectively translates the rotary die cylinder along the X-axis, translates the rotary die cylinder along the Y-axis, and rotates the rotary die cylinder about the theta axis according to the registration error calculated.

17. The rotary die apparatus of claim 16, further comprising a frame supporting the rotary die, wherein the three-crank adjustment mechanism includes three crank arms each operable to selectively pivot and selectively slide in order to cooperatively move the frame and the rotary die attached thereto along or about each of the X-axis, the Y-axis, and the theta axis.

18. The rotary die apparatus of claim 15, wherein the actuators include a stacked X-Y-T mechanism having three moveable frames that selectively translate the rotary die cylinder along the X-axis, translate the rotary die cylinder along the Y-axis, and rotate the rotary die cylinder about the theta axis according to the registration error calculated.

* * * * *